US010780499B2

(12) United States Patent
Zhu et al.

(10) Patent No.: US 10,780,499 B2
(45) Date of Patent: Sep. 22, 2020

(54) POWDER FEED FOR INJECTION MOLDING PROCESS AND METHOD FOR MANUFACTURING POROUS METAL

(71) Applicant: CHAMP TECH OPTICAL (FOSHAN) CORPORATION, Foshan (CN)

(72) Inventors: Jin-Hong Zhu, Foshan (CN); Dung-Chang Yeh, New Taipei (TW)

(73) Assignee: CHAMP TECH OPTICAL (FOSHAN) CORPORATION, Foshan (CN)

( * ) Notice: Subject to any disclaimer, the term of this patent is extended or adjusted under 35 U.S.C. 154(b) by 0 days.

(21) Appl. No.: 16/286,983

(22) Filed: Feb. 27, 2019

(65) Prior Publication Data

US 2020/0164434 A1 May 28, 2020

(30) Foreign Application Priority Data

Nov. 27, 2018 (CN) ..... 2018 1 1428296

(51) Int. Cl.

| | |
|---|---|
| ***B22F 3/11*** | (2006.01) |
| ***B22F 1/00*** | (2006.01) |
| ***B22F 3/22*** | (2006.01) |
| ***B22F 3/16*** | (2006.01) |
| ***C23F 1/28*** | (2006.01) |
| ***B22F 3/24*** | (2006.01) |

(52) U.S. Cl.

CPC ..... *B22F 3/11* (2013.01); *B22F 1/0007* (2013.01); *B22F 1/0059* (2013.01); *B22F 1/0096* (2013.01); *B22F 3/16* (2013.01); *B22F 3/225* (2013.01); *B22F 3/24* (2013.01); *C23F 1/28* (2013.01); *B22F 2003/241* (2013.01); *B22F 2301/35* (2013.01); *B22F 2998/10* (2013.01)

(58) Field of Classification Search

None

See application file for complete search history.

(56) References Cited

U.S. PATENT DOCUMENTS 4,765,950 A * 8/1988 Johnson ..... C04B 35/63492 419/2

6,759,004 B1 * 7/2004 Dwivedi ..... B22F 1/0059 264/125

FOREIGN PATENT DOCUMENTS

CN 104152903 A 11/2014

CN 104308163 A 1/2015

* cited by examiner

*Primary Examiner* — Jiong-Ping Lu

(74) *Attorney, Agent, or Firm* — ScienBiziP, P.C.

(57) ABSTRACT

A method for manufacturing a porous metal with enhanced ability to bond to a plastic subsequently powder feed for injection molding process provides a powder feed to an injection molding process, to form a green embryo. The green embryo is sent into a sintering furnace for high-temperature sintering to obtain a blank sintered product. A chemical reagent is applied to form pores on the sintered product. The powder feed includes first and second metal powders evenly mixed. The second metal powder has a mass percentage of about less than 10% of a total mass of the powder feed for injection molding process. The first metal powder is corrosion-resistant. The second metal powder is readily corrodible.

7 Claims, 1 Drawing Sheet

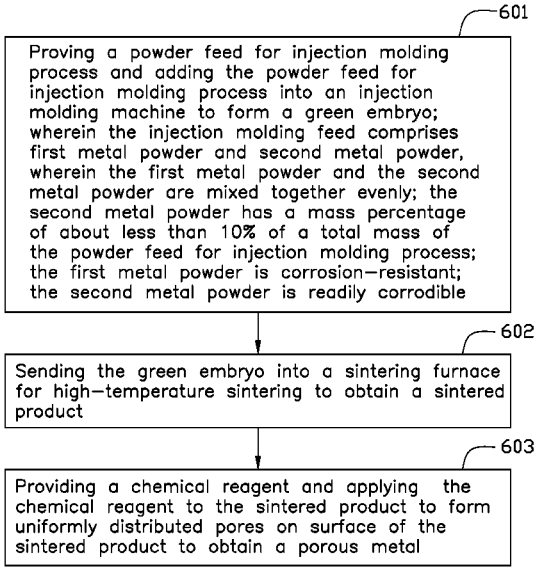

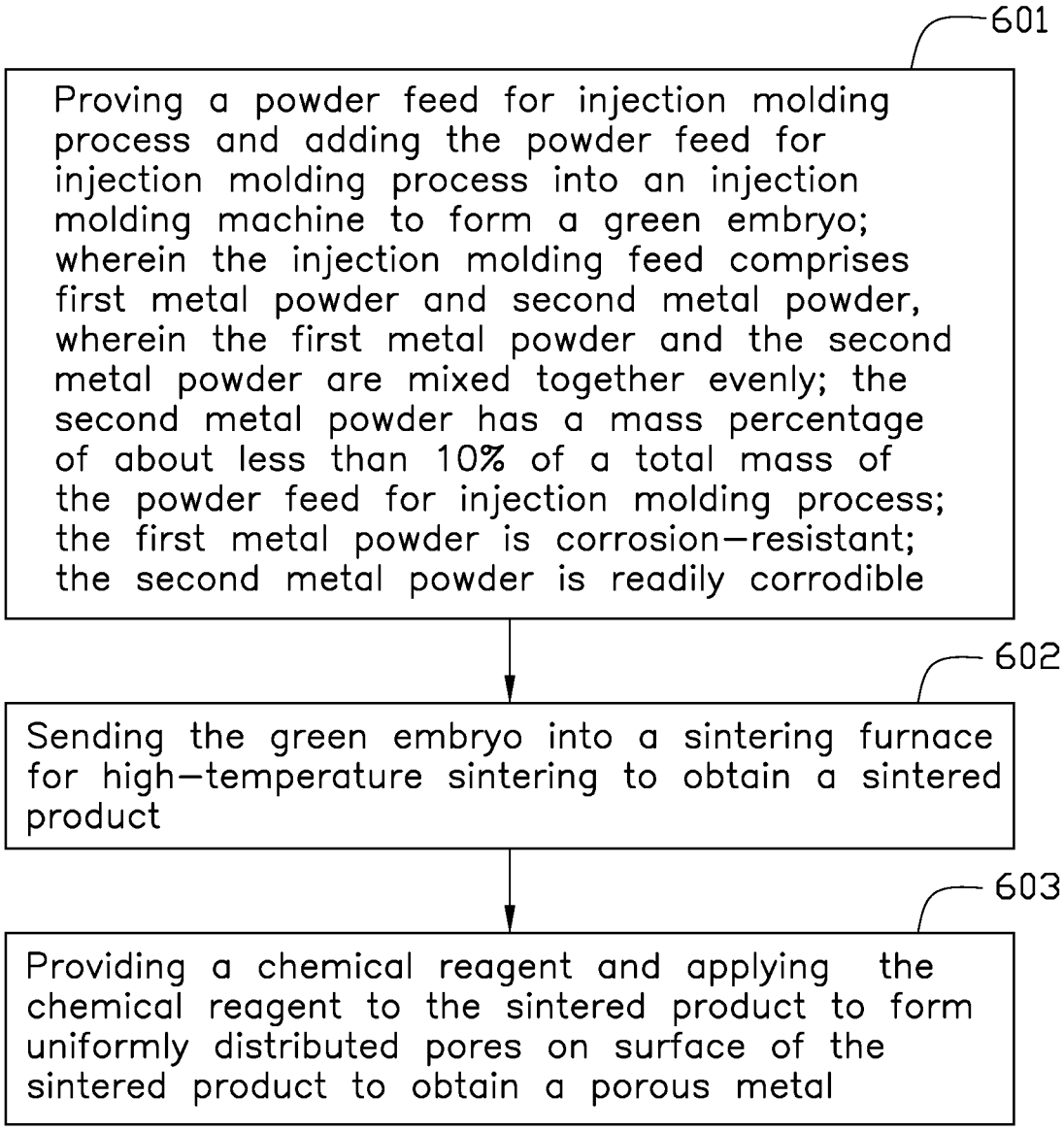
601
Proving a powder feed for injection molding process and adding the powder feed for injection molding process into an injection molding machine to form a green embryo; wherein the injection molding feed comprises first metal powder and second metal powder, wherein the first metal powder and the second metal powder are mixed together evenly; the second metal powder has a mass percentage of about less than 10% of a total mass of the powder feed for injection molding process; the first metal powder is corrosion-resistant; the second metal powder is readily corrodible
602
Sending the green embryo into a sintering furnace for high-temperature sintering to obtain a sintered product
603
Providing a chemical reagent and applying the chemical reagent to the sintered product to form uniformly distributed pores on surface of the sintered product to obtain a porous metal

POWDER FEED FOR INJECTION MOLDING PROCESS AND METHOD FOR MANUFACTURING POROUS METAL

FIELD

The subject matter disclosed herein generally relates to injection molding of powder material.

BACKGROUND

Porous materials are widely applied in many industries. The calculation and control of fluid passages of ordered porous materials are relatively easier compared to those of disordered structures. The ordered porous material can be made by a diffusion sintering method and a template method but the methods are slow in production, high in cost, and not suitable for mass production.

Therefore, there is room for improvement in the art.

BRIEF DESCRIPTION OF THE DRAWING

Implementations of the present disclosure will now be described, by way of embodiments only, with reference to the attached FIGURE.

A drawing shows a flowchart of an exemplary embodiment of a method for manufacturing a porous metal.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain portions may be exaggerated to better illustrate details and features of the present disclosure.

The disclosure is illustrated by way of example and not by way of limitation in the drawing. It should be noted that references to "an" or "one" embodiment in this disclosure are not necessarily to the same embodiment, and such references mean "at least one."

The term "comprising," when utilized, means "including, but not necessarily limited to", it specifically indicates open-ended inclusion or membership in the so-described combination, group, series, and the like.

Embodiments of a powder feed for injection molding process are disclosed. The powder feed for injection molding process includes first metal powder, second metal powder, and binder. The first metal powder, the second metal powder, and the binder are mixed together evenly.

In at least one exemplary embodiment, the second metal powder has a mass percentage of about less than 10% of a total mass of the powder feed for injection molding process, and the binder has a mass percentage of about less than 10% of the total mass of the powder feed for injection molding process.

The first metal powder is corrosion-resistant.

In at least one exemplary embodiment, particles of the first metal powder are micron-sized.

In at least one exemplary embodiment, the first metal powder is stainless steel metal powder. The stainless steel metal powder may be at least one of 17-4PH, 316L, SKD61, and the like. In the present embodiment, the stainless steel metal powder is 17-4 PH.

The second metal powder forms uniformly distributed pores on a porous metal to form a porous metal. The uniformly distributed pores enhance the bonding between metal and a plastic in a subsequent insert molding process.

The second metal powder is readily corrodible.

In at least one exemplary embodiment, particles of the second metal powder are also micron-sized.

The second metal powder is at least one of a carbon-based iron powder, a low carbon steel-based alloy powder, and the like. In at least one exemplary embodiment, the second metal powder is a carbon-based iron powder known as G1010.

The binder can be at least one of high glass transition temperature polymer, plastic-based binder, wax-based binder, and the like. The high glass transition temperature polymer can be at least one of polymethyl methacrylate (PMMA), polycarbonate (PC), and the like.

In at least one exemplary embodiment, the binder is a plastic-based binder.

In at least one embodiment, the plastic-based binder is a polyformaldehyde (POM) binder.

The powder feed for injection molding process further includes a booster. The booster is mixed evenly with the first metal powder, the second metal powder, and the binder.

The booster may be a flow modifier, a toughening compatibilizer, or the like.

The flow modifier may be polypropylene flow modifier, PC.ABS flow modifier, polyester flow modifier, high impact polystyrene flow modifier, or the like.

The toughening compatibilizer may be cyclic acid anhydride type compatibilizer, carboxylic acid type compatibilizer, epoxy type compatibilizer, oxazoline type compatibilizer, imide type compatibilizer, isocyanate type compatibilizer, or the like.

The drawing illustrates a flowchart of a method for manufacturing the porous metal. The method is provided by way of example, as there are a variety of ways to carry out the method. The method described below can be carried out using the flowchart illustrated, for example, and various elements of the drawing are referenced in explaining at least one embodiment of the method. Each block represents one or more processes, methods, or subroutines, carried out in an embodiment of the method. Furthermore, the expressed order of blocks is by example only and the order of the blocks may change. Additional blocks may be added or fewer blocks may be used, without departing from this disclosure. The exemplary method may begin at block 601.

At block 601, a powder feed for injection molding process is provided and the powder feed for injection molding process is added into an injection molding machine (not shown) to form a green embryo.

The powder feed for injection molding process includes first metal powder, second metal powder, and binder. The first metal powder, the second metal powder, and the binder are mixed together evenly.

In at least one embodiment, the second metal powder has a mass percentage of about less than 10% of a total mass of the powder feed for injection molding process, and the binder has a mass percentage of about less than 10% of the total mass of the powder feed for injection molding process.

The first metal powder is corrosion-resistant.

In at least one embodiment, particles of the first metal powder are micron-sized.

In at least one exemplary embodiment, the first metal powder is stainless steel metal powder. The stainless steel metal powder may be at least one of 17-4PH, 316L, SKD61, and the like. In the present embodiment, the stainless steel metal powder is 17-4 PH.

The second metal powder forms uniformly distributed pores on a metal to form a porous metal. The uniformly distributed pores enhance the bonding between metal and a plastic in a subsequent insert molding process.

The second metal powder is a readily corrodible metal in powder form.

In at least one embodiment, particles of the second metal powder are micron-sized.

The second metal powder is at least one of a carbon-based iron powder, a low carbon steel-based alloy powder, and the like. In at least one embodiment, the second metal powder is a carbon-based iron powder of G1010.

The binder can be at least one of high glass transition temperature polymer, plastic-based binder, wax-based binder, and the like. The high glass transition temperature polymer can be at least one of a polymethyl methacrylate (PMMA), a polycarbonate (PC), and the like.

In at least one embodiment, the binder is a plastic-based binder.

In at least one exemplary embodiment, the plastic-based binder is a polyformaldehyde (POM) binder.

The powder feed for injection molding process further includes a booster. The booster is mixed evenly with the first metal powder, the second metal powder, and the binder.

The booster may be a flow modifier, a toughening compatibilizer, or the like.

The flow modifier may be polypropylene flow modifier, PC.ABS flow modifier, polyester flow modifier, high impact polystyrene flow modifier, or the like.

The toughening compatibilizer may be cyclic acid anhydride type compatibilizer, carboxylic acid type compatibilizer, epoxy type compatibilizer, oxazoline type compatibilizer, imide type compatibilizer, isocyanate type compatibilizer, or the like.

At block 602, the green embryo is sent into a sintering furnace for high-temperature sintering to obtain a sintered product.

Temperature of the high-temperature sintering is 1300±5 degrees Celsius.

At block 603, chemical reagent is provided and applied to the sintered product to form uniformly distributed pores on surface of the sintered product to form a porous metal.

The second metal powder is etched by the chemical reagent to form the plurality of uniformly distributed pores. In a subsequent insert molding process, plastics penetrating into the uniformly distributed pores form fine natural inverted structures to enhance the bonding strength of plastic to the porous metal.

The chemical reagent may be aqua regia weak solution with 75% HCL+25% $HNO_3$, aqua regia weak solution with solute containing $Cl^-$, or the like.

In at least one exemplary embodiment, the solute contains $Cl^-$ is $FeCl_3$.

The inclusion of the second metal powder, which is readily corrodible, describes that the second metal powder is etched by the chemical reagent to form uniformly distributed pores on surface of the sintered product. Such method for manufacturing a porous metal has a fast manufacturing speed, a low cost, and can be mass-produced.

The embodiments shown and described above are only examples. Many details are often found in the art such as the other features of a powder feed for injection molding and a porous metal. Therefore, many such details are neither shown nor described. Even though numerous characteristics and advantages of the present disclosure have been set forth in the foregoing description, together with details of the structure and function of the present disclosure, the disclosure is illustrative only, and changes can be made in the detail, including in matters of shape, size, and arrangement of the parts within the principles of the present disclosure, up to and including the full extent established by the broad general meaning of the terms used in the claims. It will therefore be appreciated that the embodiments described above can be modified within the scope of the claims.

What is claimed is:

1. A method for manufacturing a porous metal, comprising: providing a powder feed for injection molding process and adding the powder feed for injection molding process into an injection molding machine to form a green embryo; wherein the injection molding feed comprises first metal powder and second metal powder, wherein the first metal powder and the second metal powder are mixed together evenly; the second metal powder has a mass percentage of about less than 10% of a total mass of the powder feed for injection molding process; sending the green embryo into a sintering furnace for sintering to obtain a sintered product; and providing a chemical reagent and applying the chemical reagent to the sintered product to form uniformly distributed pores on surface of the sintered product to obtain a porous metal; wherein the first metal powder is resistant to the corrosion by the chemical reagent, and the second metal powder is corrodible in the chemical reagent.

2. The method of claim 1, wherein temperature of the sintering is 1300±5 degrees Celsius.

3. The method of claim 1, wherein the chemical reagent is aqua regia solution with 75% HCL+25% $HNO_3$ or aqua regia solution with solute containing $Cl^-$.

4. The method of claim 1, wherein the first metal powder is a stainless steel metal powder.

5. The method of claim 1, wherein the second metal powder is at least one of a carbon-based iron powder and a low carbon steel-based alloy powder.

6. The method of claim 1, wherein the injection molding feed further comprises a binder; the first metal powder, the second metal powder, and the binder are mixed together evenly.

7. The method of claim 1, wherein the binder has a mass percentage of about less than 10% of the total mass of the powder feed for injection molding process.

* * * * *